US009404281B1

(12) United States Patent
Donnay

(10) Patent No.: US 9,404,281 B1
(45) Date of Patent: Aug. 2, 2016

(54) ADJUSTABLE CANOPY

(71) Applicant: PAC OF MICHIGAN, LLC, West Bloomfield, MI (US)

(72) Inventor: John Donnay, West Bloomfield, MI (US)

(73) Assignee: Adjustable Canopy, LLC, West Bloomfield, MI (US)

( * ) Notice: Subject to any disclaimer, the term of this patent is extended or adjusted under 35 U.S.C. 154(b) by 0 days.

(21) Appl. No.: 14/509,236

(22) Filed: Oct. 8, 2014

Related U.S. Application Data

(60) Provisional application No. 61/888,056, filed on Oct. 8, 2013.

(51) Int. Cl.
*E04H 15/44* (2006.01)
*E04H 15/36* (2006.01)
*E04H 15/34* (2006.01)

(52) U.S. Cl.
CPC ..... *E04H 15/44* (2013.01); *E04H 15/34* (2013.01); *E04H 15/36* (2013.01)

(58) Field of Classification Search
CPC ..... E04H 15/26; E04H 15/28; E04H 15/44; E04H 15/46; E04H 15/52
USPC ..... 135/128, 129, 141
See application file for complete search history.

(56) References Cited

U.S. PATENT DOCUMENTS 2,470,337 A 5/1949 Campbell
2,698,629 A 1/1955 Hall
2,708,346 A 5/1955 Smith
3,030,973 A 4/1962 Janda et al.
3,165,111 A * 1/1965 Foster ..... 114/361
3,231,305 A * 1/1966 Beckman ..... 296/100.12
3,415,260 A * 12/1968 Hall ..... B60P 7/02 135/129
3,469,587 A * 9/1969 Folkes ..... 135/129
3,729,890 A * 5/1973 Yamamoto et al. ..... 52/646
3,845,591 A * 11/1974 Stine ..... 52/67
3,909,993 A 10/1975 Huddle
4,487,212 A 12/1984 Moore
5,005,896 A * 4/1991 Li ..... 296/100.18
5,281,077 A 1/1994 Phillips
5,338,084 A * 8/1994 Wardell ..... 296/105
5,546,972 A * 8/1996 Wardell et al. ..... 135/129
5,709,501 A 1/1998 Elbers
5,775,353 A 7/1998 Johnson
5,924,759 A * 7/1999 DeMonte et al. ..... 296/100.12
6,109,283 A * 8/2000 Burke et al. ..... 135/129
6,257,260 B1 * 7/2001 Phillips ..... 135/88.13
6,430,879 B1 * 8/2002 Nuiry et al. ..... 52/67
6,786,171 B1 9/2004 Elbers (Continued)

FOREIGN PATENT DOCUMENTS

EP 1795067 A1 6/2007
WO 2006032077 A1 3/2006
WO 2013044162 A1 3/2013

*Primary Examiner* — Noah Chandler Hawk
(74) *Attorney, Agent, or Firm* — Carlson, Gaskey & Olds P.C.

(57) ABSTRACT

An example canopy according to this disclosure includes, among other things, a column, and support including a track extending in a longitudinal direction. The support is connected to the column. The canopy further includes a frame member, and at least one follower connected to the frame member. The at least one follower is received in the track such that the frame member is slidable in the longitudinal direction.

14 Claims, 3 Drawing Sheets

(56) References Cited

U.S. PATENT DOCUMENTS

| | | | | |
|---|---|---|---|---|
| 6,976,433 | B1 * | 12/2005 | Neumann | 105/377.03 |
| 7,182,688 | B2 | 2/2007 | Coulton | |
| 7,194,976 | B1 | 3/2007 | Kramer | |
| 7,270,075 | B1 * | 9/2007 | Jones | 114/361 |
| 7,455,026 | B2 | 11/2008 | Towley, III et al. | |
| 8,359,994 | B1 | 1/2013 | Highfield | |
| 2003/0145882 | A1 * | 8/2003 | Sanna | 135/128 |
| 2008/0210284 | A1 * | 9/2008 | Dubois | 135/129 |
| 2009/0293797 | A1 | 12/2009 | Kent | |
| 2013/0014793 | A1 * | 1/2013 | Gerengi | 135/96 |

* cited by examiner

ADJUSTABLE CANOPY

RELATED APPLICATIONS

This application claims the benefit of U.S. Provisional Application No. 61/888,056, filed Oct. 8, 2013, the entirety of which is herein incorporated by reference.

BACKGROUND

Boats are often stored on a hoist adjacent a dock. Such hoists may include a fixed canopy covering the boat from above. In other examples, boats are moored in a body of water (e.g., not on a hoist) under a fixed canopy. In either case, the canopy is intended to protect the boat from the sun, wind, rain and other elements.

SUMMARY

An illustrative example canopy includes a column, and a support including a track extending in a longitudinal direction. The support is connected to the column. The canopy further includes a frame member, and at least one follower connected to the frame member. The at least one follower is received in the track such that the frame member is moveable in the longitudinal direction.

Another example canopy includes a support having a track extending in a longitudinal direction, and a frame member moveable in the longitudinal direction. In this example canopy, a horizontal dimension of the frame member is adjustable.

A further example canopy includes a support extending in a longitudinal direction. The canopy also includes a first frame member connected to a first trolley. The first frame member is moveable in the longitudinal direction between a collapsed position and an expanded position. The canopy additionally includes a second frame member connected to a second trolley. The second frame member is moveable in the longitudinal direction between the collapsed position and the expanded position. In this example, when the first and second frame members are in the collapsed position, the first and second trolleys at least partially overlap one another in at least one of a vertical direction and a horizontal direction.

BRIEF DESCRIPTION OF THE DRAWINGS

In FIG. 4, a fabric layer is provided over the frame members, which are shown in phantom.

DETAILED DESCRIPTION

Figure 1:
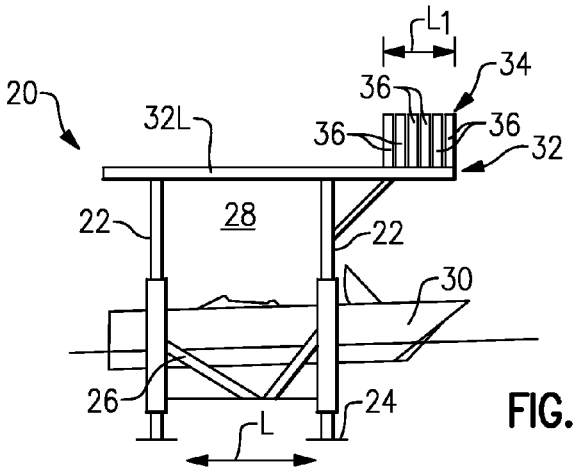
FIG. 1 is a side view of an example hoist.
Figure 2:
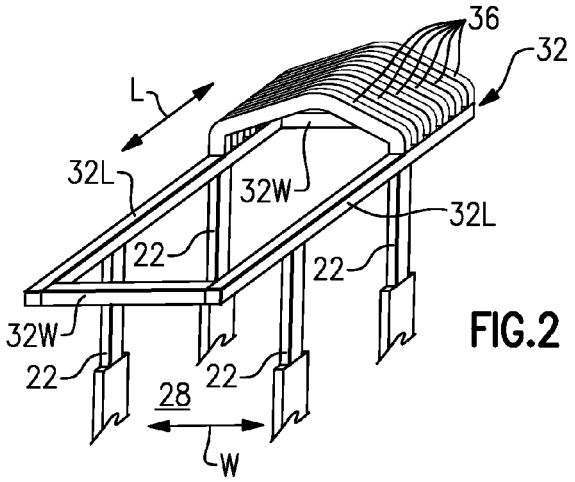
FIG. 2 is a perspective view of an example hoist.

FIGS. 1 and 2 illustrate an example hoist 20. The hoist 20 includes a plurality of columns 22 extending upward from a sea or lake bottom 24. The hoist 20 may include a vertically moveable boat support 26, which may be operated by a known manual or automatic lifting mechanism.

A slip 28 is defined between the columns 22. The columns 22 are spaced-apart from one another to provide the slip 28 with a width W corresponding to an expected width, or horizontal dimension, of a boat 30. As known, the boat 30 enters and exits the slip 28 in a longitudinal direction, along the length L of the slip 28.

A canopy support 32 is supported near the top of the columns 22. The canopy support 32 in this example includes a pair of longitudinal supports 32L extending substantially parallel to the length L of the slip 28, and a pair of cross supports 32W extending between the longitudinal supports 32L in the direction of the width W of the slip 28. In some examples, the cross supports 32W are not required. In examples where the cross supports 32W are included, the cross supports 32W may be removable or retractable.

The canopy support 32 supports a retractable canopy 34. Use of the term "canopy" in this document refers to the retractable canopy 34 and the corresponding support structure, including components of the canopy support 32 and the corresponding supports associated with the hoist 20.

Figure 3:
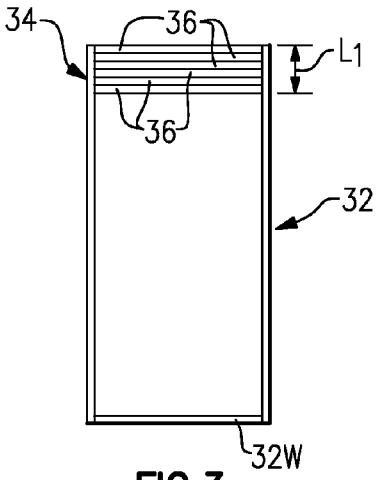
FIG. 3 is a top view of a canopy support and a plurality of frame members in a collapsed position.

The retractable canopy 34 is configured to be selectively expanded and collapsed to cover and expose the deck of the boat 30, respectively. In particular, the effective length of the retractable canopy 34 is adjustable between a collapsed length $L_1$ (seen from above in FIG. 3) and a fully expanded length $L_2$ (seen from above in FIG. 4). The fully expanded length $L_2$ in one example is substantially equal to the length of the longitudinal supports 32L. The effective length of the retractable canopy 34 may further be adjusted to any length between the collapsed length $L_1$ and the fully expanded length $L_2$ to selectively expose a desired portion of the deck of the boat 30. While the retractable canopy 34 is situated above the hoist 20, it should be understood that the canopy could be situated in another location where adjustability of a covering is desired, such as in applications where a boat is covered adjacent a dock without being placed on a hoist.

The retractable canopy 34 may be expanded and collapsed manually or automatically. In the former case, a user may physically slide the retractable canopy 34 using a tool or the user's hands, as examples. In the latter case, the retractable canopy 34 may be fit with one or more actuators, a reel, and a cable, for example, to selectively move the canopy in response to commands from a user-controlled interface.

Figure 4:
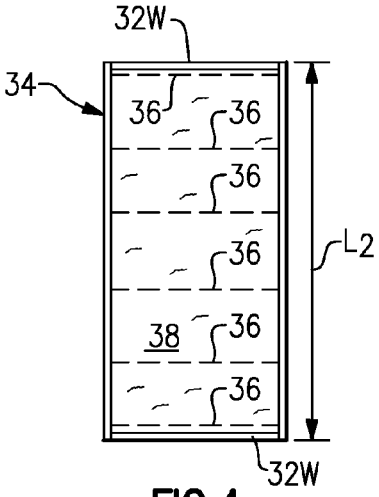
FIG. 4 is a top view of a canopy with the frame members in an expanded position.
Figure 5:
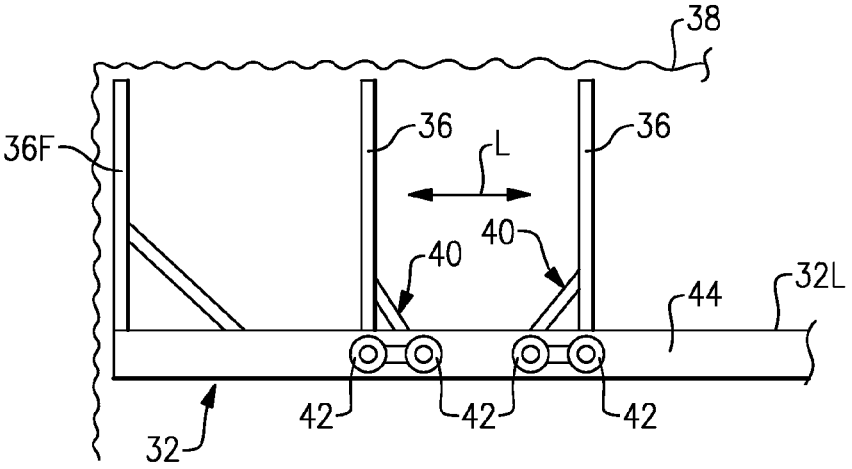
FIG. 5 illustrates a first canopy support arrangement.

The example retractable canopy 34 includes a plurality of frame members 36 (perhaps best seen in FIG. 2) supporting a fabric layer 38 (FIGS. 4 and 5). The frame members 36 generally resemble an inverted U-shape. In one example, the fabric layer 38 is canvas, although other suitable fabrics may be used. The fabric layer 38 may be a single piece of fabric, or may include several pieces of fabric.

The frame members 36 are configured to travel in the longitudinal direction L along the canopy support 32 to facilitate adjusting the effective length of the retractable canopy 34. With reference to FIG. 5, each frame member 36 includes a trolley 40 near the two ends of the frame member 36. Each trolley 40 includes followers 42, which in this example are wheels. The followers are configured to move along, and "follow" the track. The followers 42 do not need to be wheels, and could be another type of slider or roller.

In this example, the track 44 is integrated into one of the longitudinal supports 32L. In one example, the longitudinal supports 32L are extruded pieces of aluminum, and the track 44 is integrally formed during the extrusion process. It should be understood that this disclosure is not limited to extruded aluminum, however. Other manufacturing techniques, and other materials, such as steel, may be used.

The frame members 36 may be moveable independent from one another, or may be linked together (e.g., by a semi-rigid connector or the fabric layer 38) for increased stability. Further, while the illustrated trolleys 40 include two followers 42, the trolleys 40 may include any number of followers, although having at least two followers 42 may provide increased stability relative to a trolley 40 having only one follower.

The example of FIG. 5 includes a fixed frame member 36F provided at one end of the canopy support 32. In this example, the fixed frame member 36F does not translate along the canopy support 32, and remains fixed in place near one end of the longitudinal supports 32L. Some example embodiments do not include a fixed frame member 36F. It may be desirable for all of the frame members 36 to be moveable, to selectively expose different portions of the boat 30 at different times (e.g., depending on the location of the sun).

Figure 6:
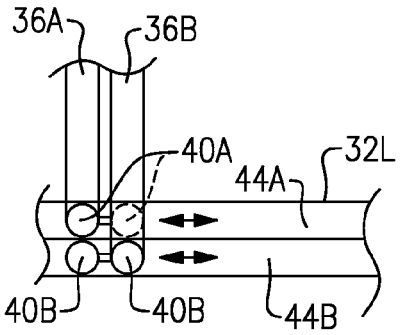
FIG. 6 illustrates a second canopy support arrangement.
Figure 7:
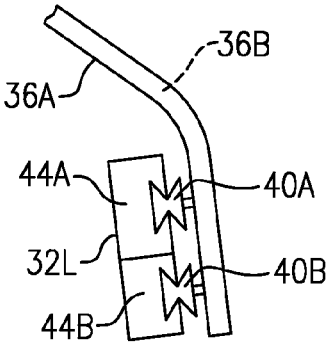
FIG. 7 illustrates the followers of the canopy support of FIG. 6 within a respective track.

While a single track 44 is illustrated in FIG. 5, the longitudinal supports 32L can include multiple tracks. For instance, as illustrated in FIGS. 6-7, the longitudinal supports 32L include vertically aligned tracks. As illustrated, the longitudinal supports include a first, upper track 44A and second, lower track 44B arranged vertically below the first track 44A. As shown in FIG. 6, a first frame member 36A is connected to a first trolley 40A, which is moveable along the first, upper track 44A. The second frame member 36B is connected to a second trolley 40B, which is moveable along the second, lower track 44B. While the frame members 36A, 36B are illustrated as being separate from the trolleys 40A, 40B, the frame members 36A, 36B could be integrally formed with the trolleys 40A, 40B.

When the retractable canopy 34 is collapsed, the first trolley 40A is positioned vertically above the second trolley 40B. Accordingly, when the retractable canopy 34 is collapsed, the first and second frame members 36A, 36B are situated relatively close to one another in the longitudinal direction L when compared to the example of FIG. 5 (where there is only a single track). The closer longitudinal positions of the frame members 36 in this example provides the retractable canopy 34 with a reduced collapsed length $L_1$. Providing at least a partial vertical overlap between adjacent trolleys or trolley followers reduces the length of the canopy in the collapsed position. It should be understood that while only two frame members 36A, 36B are illustrated in FIG. 6, any number of frames can be included along the length of the canopy support 32.

Figure 8:
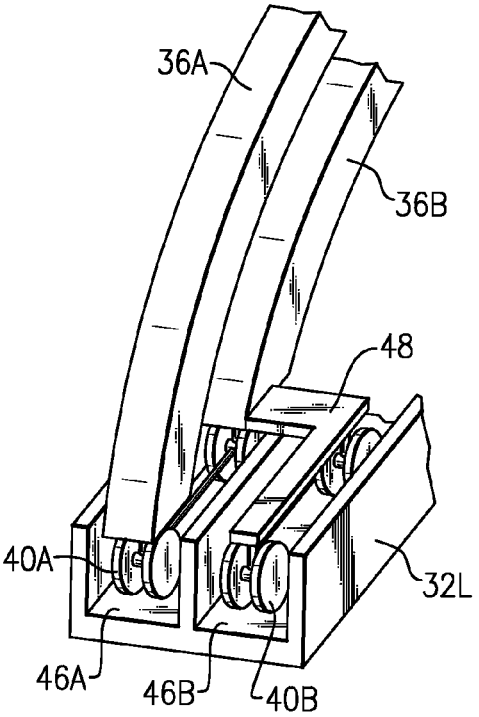
FIG. 8 illustrates another canopy support arrangement.

FIG. 8 illustrates an alternative embodiment for packaging adjacent trolleys 40A, 40B. In this example, the longitudinal supports 32L include horizontally aligned, side-by-side tracks 46A, 46B. The frame member 36B is attached to a horizontal adapter 48, such that the trolley 40B is horizontally offset, in the direction of the width W, from the trolley 40A. Similar to FIGS. 6-7, the trolleys 40A, 40B do not interfere with one another, and are arranged horizontally side-by-side when the retractable canopy 34 is collapsed. Again, this provides a reduced collapsed length $L_1$ for the retractable canopy 34 compared to example where both trolleys 40A, 40B would have their followers in the same track.

It should be noted that, while FIGS. 6-8 show the longitudinal supports 32L as having only two tracks (e.g., 44A, 44B and 46A, 46B), the longitudinal supports 32L could include additional tracks. Additional tracks may allow for tighter packaging of trolleys in some examples, which in turn leads to a reduced collapsed length $L_1$.

Figure 9:
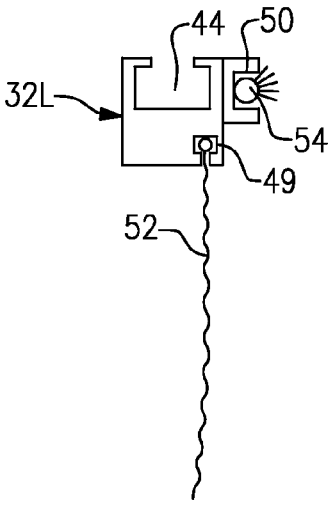
FIG. 9 illustrates an example track including a side curtain channel and a light channel.

As illustrated in FIG. 9, the longitudinal supports 32L may optionally include a side curtain channel 49 and a light channel 50. The side curtain channel 49 may support a side curtain 52 of a desired (or adjustable) length, to cover the sides of the boat 30 or otherwise establish a vertical barrier along the edges of the area beneath the retractable canopy 34. The light channel 50 is configured to support a light 54, such as an LED rope, which may be used to illuminate the interior of the slip 28.

The channels 49, 50 are formed integrally with the respective longitudinal support 32L during an extrusion process, in one example. The cross supports 32W may also include side curtain channels 49 and light channels 50. The longitudinal and cross supports 32L, 32W may also include channels configured to receive fasteners to connect the supports 32L, 32W to one another, and to the columns 22.

Figure 10:
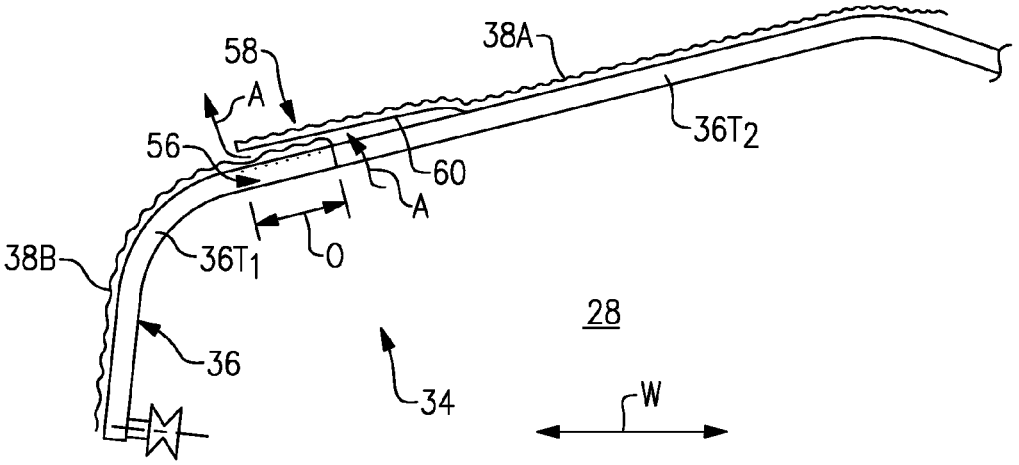
FIG. 10 illustrates a canopy having an adjustable width frame member.

The disclosed retractable canopy 34 may be retrofit to an existing hoist, or sold together with a new hoist. In the example where the retractable canopy 34 is retrofit to an existing hoist 20, the width of the retractable canopy 34 may be adjustable to accommodate different hoist sizes. As illustrated in FIG. 10, each of the frame members 36 may be provided with a width adjustment feature 56. The width adjustment feature 56 in this example is provided by a first telescopic member $36T_1$ which is configured to at least partially telescopically receive a moveable second telescopic member $36T_2$. A third telescopic member (not illustrated) may be positioned on the opposite side of the frame 36, although the third frame member is not required in all examples.

An inner one of the first and second telescopic members $36T_1$, $36T_2$ may include a biased pin, and the other of the first and second telescopic members $36T_1$, $36T_2$ may include a plurality of openings to receive the biased pin. Other adjustment mechanisms for setting a desired width of the frame members 36 may be used instead of a biased pin.

In examples where the frame member 36 is adjustable in the direction of the width W, the retractable canopy 34 may include one or more fabric shingles 58. While not illustrated, another shingle may be provided on the opposite side of the frame member 36 to accommodate additional width adjustment. In one example, a fabric shingle 58 is provided by a relatively rigid flap 60 secured to a first piece of fabric 38A. The flap 60 vertically overlaps a second piece of fabric 38B. This overlap is shown at "0" in FIG. 10. As the frame member 36 is adjusted in the direction of the width W, the pieces of fabric 38A, 38B remain vertically overlapped. The flap 60 further provides a ventilation feature allowing the egress of air A from within the slip 28, which minimizes stresses from wind and prevents mold formation. Further, providing multiple pieces of fabric may reduce the expense of maintaining the retractable canopy 34, as the smaller individual pieces of fabric (e.g., 38A, 38B) can be replaced (if needed over time) as opposed to a larger single piece of fabric.

The example canopy sufficiently covers and protects a boat when expanded, while also allowing for exposure of the boat deck to sunlight, for example, to allow individuals to use the boat deck as an enjoyable outdoor space while the boat is in the hoist area, or to allow the boat to be moored while air-drying.

Some of the illustrated features provide tight packaging for the trolleys, to minimize the collapsed length of the retractable canopy, which leads to increased deck exposure. Further, the retractable canopy may include an adjustable width, which increases the ease of retrofitting the canopy to an existing hoist.

Although the different examples have the specific components shown in the illustrations, other embodiments are not limited to those particular combinations. It is possible to use some of the components or features from one of the examples in combination with features or components from another one of the examples.

One of ordinary skill in this art would understand that the above-described embodiments are exemplary and non-limiting. That is, modifications of this disclosure would come within the scope of the claims. Accordingly, the following claims should be studied to determine their true scope and content.

What is claimed is:

1. A canopy, comprising:

a column;

a support connected to the column, the support including a first track and a second track, each of the first and second tracks extending in a longitudinal direction;

three or more frame members, each of the frame members connected to a respective trolley; and each of the trolleys including at least one follower, wherein the at least one followers of adjacent frame members are received in an alternating one of the first and second tracks, and wherein all followers associated with a respective trolley are received in the same one of the first and second tracks.

2. The canopy as recited in claim 1, wherein the first track is positioned at least partially above the second track.

3. The canopy as recited in claim 2, wherein:

first and second trolleys associated with respective first and second frame members each include two followers;

both followers of the first trolley are received within the first track; and both followers of the second trolley are received within the second track.

4. The canopy as recited in claim 1, wherein the first track is provided on a horizontal side of the second track.

5. The canopy as recited in claim 1, wherein each of the frame members is associated with two followers, each of the followers received in one of the first and second tracks.

6. The canopy as recited in claim 1, wherein the support includes a light channel and a side curtain channel.

7. The canopy as recited in claim 1, comprising a fabric layer supported by the frame member.

8. The canopy as recited in claim 7, wherein a horizontal dimension of the frame members is adjustable.

9. The canopy as recited in claim 8, wherein the fabric layer includes a shingle provided by two overlapped fabric pieces.

10. A canopy, comprising:

a support having a first track and a second track, each of the first track and the second track extending in a longitudinal direction;

three or more frame members moveable in the longitudinal direction, each of the frame members connected to a respective trolley, and wherein a horizontal dimension of at least some of the frame members is adjustable; and each of the trolleys including at least one follower, wherein the at least one followers of adjacent frame members are received in an alternating one of the first and second tracks, and wherein all of the at least one followers associated with a respective trolley are received within the same one of the first and second tracks.

11. The canopy as recited in claim 10, wherein:

each frame member includes a first telescopic member and a second telescopic member; and the first telescopic member is telescopically received within the second telescopic member.

12. The canopy as recited in claim 11, comprising a fabric layer, the fabric layer including a shingle provided by two fabric pieces, the two overlapped fabric pieces overlapping one another in the horizontal direction adjacent the interface between the first and second telescopic members.

13. A canopy, comprising:

a support having first and second tracks extending in a longitudinal direction; a first frame member connected to a first trolley, the first trolley including at least one follower received in the first track such that the first frame member is moveable in the longitudinal direction between a collapsed position and an expanded position, wherein all followers associated with the first trolley are received in the first track;

a second frame member adjacent the first frame member and connected to a second trolley, the second trolley including at least one follower received in the second track such that the second frame member is moveable in the longitudinal direction between the collapsed position and the expanded position, wherein, when the first and second frame members are in the collapsed position, the first and second trolleys at least partially overlap one another in at least one of a vertical direction and a horizontal direction, wherein all followers associated with the second trolley are received in the second track; and a third frame member adjacent the second frame member, the second frame member provided between the first and third frame members, the third frame member connected to a third trolley, the third trolley including at least one follower received in the first track such that the third frame member is moveable in the longitudinal direction between the collapsed position and the expanded position, wherein, when the first, second, and third frame members are in the collapsed position, the third trolley is not overlapped with either of the first or second trolleys, and wherein all followers associated with the third trolley are received in the first track.

14. The canopy as recited in claim 13, comprising a fabric layer supported by the first, second, and third frame members.

* * * * *